United States Patent [19]

Losey et al.

[11] Patent Number: 4,712,435

[45] Date of Patent: Dec. 15, 1987

[54] ENGINE STARTER GEARING

[75] Inventors: Walter N. Losey, Big Flats; Paul F. Giometti, Horseheads, both of N.Y.

[73] Assignee: Facet Enterprises, Inc., Tulsa, Okla.

[21] Appl. No.: 907,744

[22] Filed: Sep. 15, 1986

Related U.S. Application Data

[63] Continuation-in-part of Ser. No. 575,199, Jan. 30, 1984, Pat. No. 4,611,499.

[51] Int. Cl.[4] ..... F02N 11/00

[52] U.S. Cl. ..... 74/6; 74/7 A; 192/103 A; 192/114 R

[58] Field of Search ..... 74/6, 7 R, 7 A, 7 C; 192/103 A, 105 B, 114 R

[56] References Cited

U.S. PATENT DOCUMENTS

| | | | |
|---|---|---|---|
| 3,171,524 | 3/1965 | Croft et al. | 192/105 B |
| 3,263,509 | 8/1966 | Digby | 74/6 |
| 3,915,020 | 10/1975 | Johnson | 74/6 |
| 4,322,985 | 4/1982 | Mortensen | 192/114 R X |
| 4,346,615 | 8/1982 | Yoneda et al. | 74/7 A |
| 4,425,812 | 1/1984 | Williams | 74/6 |
| 4,611,499 | 9/1986 | Giometti | 74/7 A |

*Primary Examiner*—Allan D. Herrmann
*Attorney, Agent, or Firm*—Remy J. VanOphem

[57] ABSTRACT

Centrifugally disengageable engine starter gearing selectively starting an engine having a starting gear. The engine starter gearing includes a power shaft, a sleeve slidably secured to the power shaft, a pinion gear slidably mounted to the power shaft and movable into engagement with the starting gear, a driven clutch member secured to the pinion gear and having a generally circular recess therein, a molded plastic sleeve contained in the generally circular recess, a driving clutch member mounted to the sleeve, mutually engageable clutch teeth on the driving and driven clutch members, a barrel housing having an open end and being fitted over the driving and driven clutch members, an abutment confining the driving and driven clutch members within the housing, a resilient member biasing the driving and driven clutch members into mutual engagement, a radially inwardly extending shoulder on the driving clutch member adjacent the circular recess, and an annular thrust ring with an inner conical surface disposed in the circular recess, the annular thrust ring being adapted to abut the radially inwardly extending shoulder of the driving clutch member when displaced in a first axial direction. A plurality of centrifugal flyweight members are annularly arranged in cavities in the molded plastic sleeve. Each centrifugal flyweight member has an inclined surface abutting the conical surface of the thrust ring and operative to displace the thrust ring in the first axial direction in respose to centrifugal force. The cavities in the molded plastic sleeve extend radially outwardly and cooperate with at least a portion of the centrifugal flyweight members to prevent circumferential movement of the plurality of centrifugal flyweight members while permitting radial movement thereof.

9 Claims, 3 Drawing Figures

ENGINE STARTER GEARING

CROSS-REFERENCE TO RELATED APPLICATION

This application is a continuation-in-part of the co-pending Paul F. Giometti application Ser. No. 575,199, filed on Jan. 30, 1984, now U.S. Pat. No. 4,611,499, and assigned to the assignee hereof.

BACKGROUND OF THE INVENTION

1. Field of the Invention

The present invention relates to engine starter gearing for an engine and more particularly to engine starter gearing of a positive shift type, including a dentil clutch to provide driving and overrunning features and further including provisions for effecting the automatic separation of the clutch teeth after the engine becomes self-running.

2. Description of the Prior Art

The present invention, like the invention described in the aforesaid co-pending application Ser. No. 575,199, now U.S. Pat. No. 4,611,499 is an improvement over the starter gearing system described in U.S. Pat. No. 3,263,509 entitled "Engine Starter Drive" and issued Aug. 2, 1966, to James Digby. The above referenced patent disclosed an engine starter gearing using centrifugal weights and a conical thrust washer for separating dentil clutch teeth after engine start-up to prevent long periods of clutch overrunning and accompanying deleterious wear on the clutch teeth. An annular recess was formed in the driven clutch member. In Digby, a circular recess is provided in the face of the driven clutch member facing the driving clutch member. An annular thrust washer is fitted in the recess and abuts the driving clutch member. A conical surface is provided in the annular thrust washer facing the driven clutch member. A plurality of centrifugal flyweight members are also provided in the circular recess. The centrifugal flyweight members are provided with an inclined surface cooperating with the conical surface in the annular thrust washer, such that, when an overrunning condition occurs, the centrifugal flyweight members move outwardly and the inclined surface engages the conical surface of the annular thrust washer so as to bias the driving clutch member away from the driven clutch member. The centrifugal flyweight members are prevented from axial or rotational movement by pins extending through suitable bores in the driven clutch member and the centrifugal flyweight member.

While the engine starter gearing of Digby has been satisfactory in operation, it is difficult and expensive to assemble. This is true because a plurality of movable pins and centrifugal flyweight members must be somehow maintained in position relative to the driven clutch member during the assembly of the driven clutch member to the driving clutch member. Furthermore, the weight and, therefore, the effectiveness, of the centrifugal flyweight members is reduced by the existence of a substantial bore therethrough, in comparison to the size of the centrifugal flyweight member, for admission of the pin. The bore through the centrifugal flyweight members further reduces the strength of the flyweight members and, accordingly, limits the materials and dimensions which may advantageously be used for the centrifugal flyweight members.

The embodiment of FIGS. 3 and 4 of the aforesaid co-pending application Ser. No. 575,199, now U.S. Pat. No. 4,611,499, solved many of the aforesaid engine starter gearing disadvantages, but such embodiment requires the use of a driven clutch member which is difficult to machine and which, therefore, in practice is preferably formed by cold forming, a manufacturing technique that is less precise than machining.

What is needed, therefore, is an improved engine starter gearing using a centrifugal flyweight clutch separator which is easier and less expensive to assemble. Furthermore, what is needed is such an engine starter gearing having a more solid, compact, and durable configuration for the centrifugal flyweight member and which simplifies the manufacturing operations involved in manufacturing such engine starter gearing, particularly in regard to the driven clutch member component thereof.

SUMMARY OF THE PRESENT INVENTION

The present invention provides a novel and improved engine starter gearing. The engine starter gearing of the present invention provides a centrifugal weight clutch separator using solid unitary centrifugal flyweight members which facilitates the manufacture of the flyweight members and the assembly of the flyweight members to the engine starter gearing.

In particular, the engine starter gearing of the present invention provides a power shaft, a sleeve slidably secured to the power shaft, and helical splines on one extremity of the sleeve. A pinion gear is slidably journalled to the power shaft for axial movement relative thereto, the pinion gear being adapted for movement into and out of engagement with the starting gear of the engine to be started. A driven clutch member is secured to the pinion gear for movement therewith. A circular recess is located in the driven clutch member. A driving clutch member is slidably mounted on the helical splines of the sleeve. The driving and driven clutch members have complementary mutually engageable inclined teeth for transmitting torque therebetween in one direction of relative rotation.

A barrel housing is slidably supported on the sleeve and is provided with an open end such that the barrel housing may be fitted over the driving and driven clutch members. The driving and driven clutch members are contained within the barrel housing by abutment means. A resilient member is disposed within the barrel housing and abuts the driving clutch member so as to bias the driving and driven clutch members into mutual engagement. A radially inwardly extending shoulder is formed on the driving clutch member adjacent the recess formed in the driven clutch member. An annular thrust ring having an inner conical surface is loosely disposed in the circular recess in the driven clutch member. The annular thrust ring is adapted to abut the radially inwardly extending shoulder of the driving clutch member when displaced in a first direction.

A plurality of centrifugal flyweight members are annularly arranged in the recess in the driven clutch member. The plurality of centrifugal flyweight members each have an inclined surface abutting the conical surface of the thrust ring. The plurality of centrifugal flyweight members are operative to displace the thrust ring in a first axial direction in response to centrifugal force. A plurality of cavities are formed in a molded plastic sleeve which is inserted in the driven clutch member. The plurality of cavities each extend from the interior of the molded plastic sleeve recess and each of such cavities slidably receives at least a portion of an associated one of the plurality of centrifugal flyweight members to prevent circumferential movement of the plurality of centrifugal flyweight members, while permitting radial movement thereof.

In the preferred embodiment of structure of the present invention, the driven clutch member is provided with one or more, preferably three, radially inwardly projecting tabs which engage corresponding recesses in the outside of the plastic sleeve to help position the sleeve and the driven clutch member. Each of the flyweight members includes a portion extending longitudinally from the inclined surface into the corresponding recess in the interior of the plastic sleeve member.

A primary object of the present invention is to provide engine starter gearing which is easy to assemble. The present invention accomplishes this object by providing a plurality of unitary centrifugal flyweight members each directly engageable with a plastic sleeve within the driven clutch member so as to reduce the number of components which must be secured together during assembly and the complexity of the fabricating steps that must be followed to properly manufacture such components.

Another object of the present invention is to provide engine starter gearing having a centrifugal weight clutch separator with strong centrifugal flyweight members. The present invention satisfies this object by providing unitary flyweight members without cavities formed therein, such that the flyweight member may be formed of a wide variety of available materials.

Another object of the present invention is to provide engine starter gearing with a driven clutch member that is simple to manufacture. The present invention satisfies this object by providing a driven clutch member with an internal molded plastic sleeve, the interior of which may be precisely formed to the required complex configuration in the molding process.

These and many other objects, features and advantages of the present invention will become apparent to those skilled in the art when the following detailed description of the preferred embodiment is read together with the drawings and claims appended hereto.

DETAILED DESCRIPTION OF THE PREFERRED EMBODIMENT

Figure 1:
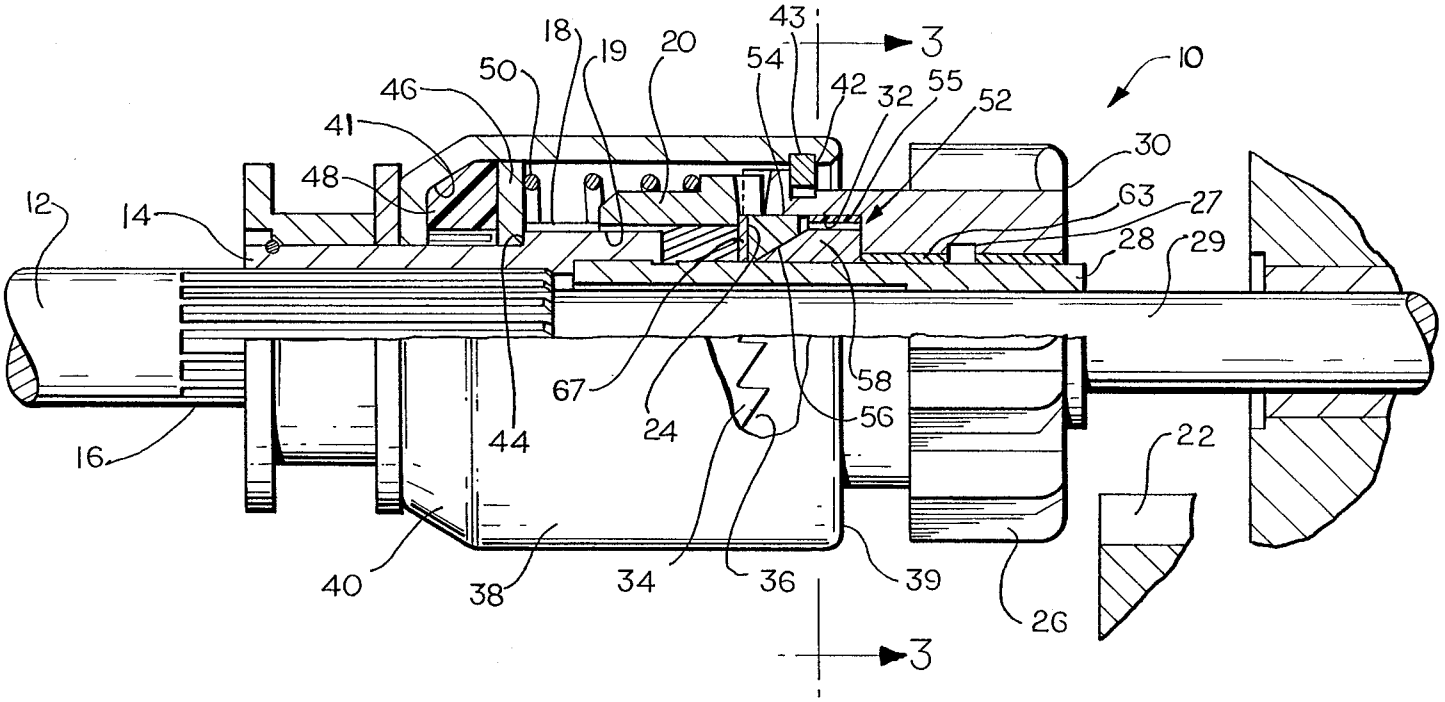
FIG. 1 is a side elevational view, partly broken away and partly in section, of the preferred embodiment of structure for an engine starter gearing according to the present invention.
Figure 2:
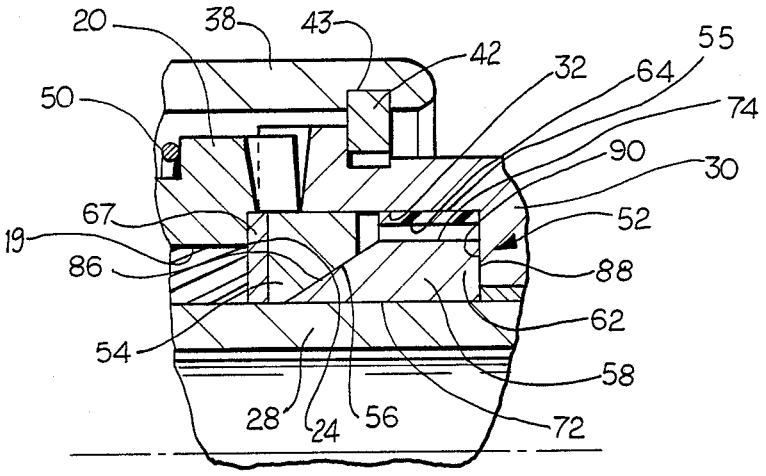
FIG. 2 is an enlarged fragmentary view of the engine starter gearing shown in FIG. 1.

Referring now to the drawing and more particularly to FIG. 1 thereof, there is illustrated a starter drive 10 for an engine, not shown, mounted to the power shaft 12 of a starting motor, also not shown. The starter drive 10 includes an axially extending sleeve 14 connected to the power shaft 12 by straight splines 16. The axially extending sleeve 14 is, therefore, axially movable relative to the power shaft 12 but may not rotate relative thereto. The external surface of the righthand extremity of the axially extending sleeve 14, as illustrated, has external helical splines 18 formed thereon. A driving clutch member 20 has internal helical splines 19 threaded onto the external helical splines 18 of the axially extending sleeve 14. The driving clutch member 20 is, therefore, adapted for movement towards and away from a starting gear 22 of the engine to be started. The driving clutch member 20 is illustrated in its engaged position in the drawing. In the engaged position, the driving clutch member 20 projects past the right end of the axially extending sleeve 14. The rightmost edge, as illustrated, of the internal helical splines 19 of the driving clutch member 20 form a radially inwardly extending shoulder 24, for a purpose to be described later.

A sleeve 28 is slidably supported on a reduced diameter portion 29 of the power shaft 12. One end of the sleeve 28 is secured to the axially extending sleeve 14. A pinion gear 26 is journalled on a bearing 63 and retained thereon by a retainer 27. The bearing 63, in turn, is mounted on the sleeve 28 thereby permitting the pinion gear 26 to be axially and rotatably movable relative to the power shaft 12. The pinion gear 26 is adapted for movement into and out of engagement with the starting gear 22 of the engine to be started. A driven clutch member 30 is integrally formed with the pinion gear 26 and extends therefrom towards the driving clutch member 20. An internal recess 32 is provided in the driven clutch member 30 adjacent the driving clutch member 20. The internal recess 32 cooperates with the sleeve 28 to define an annular channel therebetween.

The adjacent faces of the driving clutch member 20 and driven clutch member 30 are provided with dentil teeth 34 and 36, respectively, which are complementary mutually engageable inclined torque transmitting dentil teeth. The dentil teeth 34 and 36 are of the sawtooth variety to provide a one-way overrunning clutch connection.

A housing 38 having an open end 39 and a closed end 40 is slidably supported at its closed end 40 on an external surface of the axially extending sleeve 14. The housing 38 is barrel shaped and fitted over the driving clutch member 20 and partially over the driven clutch member 30. A lock ring 42 is seated in a groove 43 adjacent the open end 39 of the housing 38. The lock ring 42 has sufficient radial length to engage the driven clutch member 30 to thereby confine the driven clutch member 30 and the driving clutch member 20 within a cavity 41 of the housing 38.

The axially extending sleeve 14 is provided with a radial shoulder 44 in an intermediate location therealong to provide an abutment for a disk or washer 46 slidably journalled on the axially extending sleeve. A resiliently yieldable annular member 48, preferably formed of an elastically deformable material, such as rubber, is compressively confined between the disk 46 and the closed end 40 of the housing 38. A resilient spring member 50 is compressively confined within the cavity 41 of the housing 38 between the washer 46 and the driving clutch member 20 to provide a biasing force urging the driving clutch member 20 into engagement with the driven clutch member 30.

An advancement apparatus, not illustrated in the drawing but well known in the art, is provided for moving the starter drive 10 towards and away from the starting gear 22 of the engine.

Figure 3:
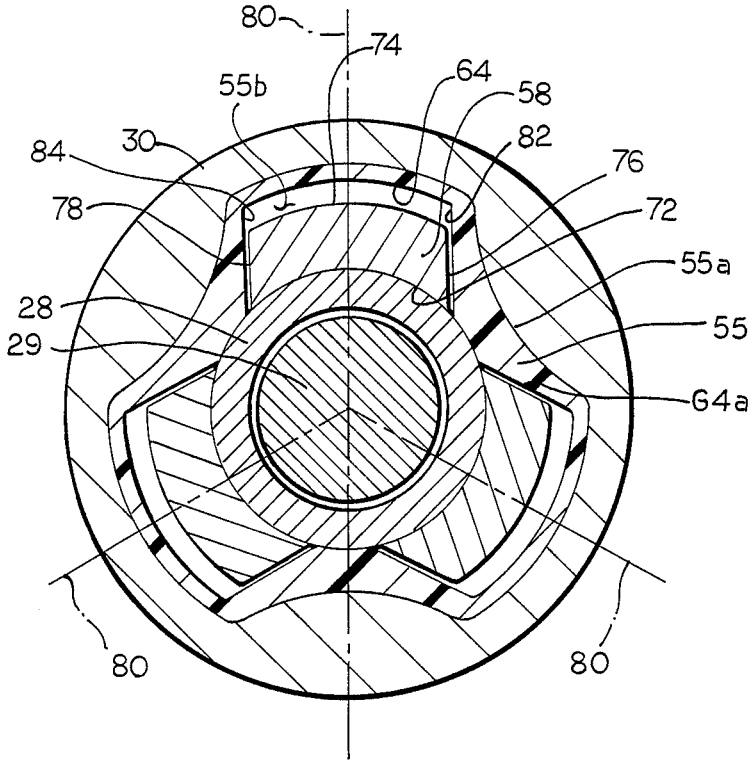
FIG. 3 is a cross-sectional view taken along lines 3—3 of FIG. 1 at a somewhat enlarged scale relative to that of FIG. 1.

The starter drive 10 is provided with a centrifugal flyweight clutch separator assembly, generally indicated by reference numeral 52, to effect disengagement of the driving clutch member 20 from the driven clutch member 30 when the engine is running above a predetermined speed. The separator assembly thereby avoids excessive wear of the mutually engaging dentil clutch teeth 34 and 36. The centrifugal flyweight clutch separator assembly 52 includes an annular thrust washer 54 disposed within the internal recess 32 located between the annular thrust washer 54 and the annular shoulder 24 of the driving clutch member 20 is a loose thrust washer 67. A sleeve-like molded plastic flyweight retainer 55 is also retained in the internal recess 32, forwardly of the annular thrust washer 54, and the external surface of the flyweight retainer 55 is provided with a circumferential series of spaced-apart recesses 55*a* each of which engages one of a circumferential series of spaced-apart tabs 64*a* on an inside surface 64 of the driven clutch member 30 to accurately circumferentially orient the flyweight retainer 55 with respect to the driven clutch member 30. The flyweight retainer 55 also is provided on its inside surface with a circumferential series of spaced-apart recesses 55*b*, as is shown in FIG. 3.

A plurality of centrifugal flyweight members 58 are fitted in the spaced-apart recesses 55*b* of the flyweight retainer. A portion 62 of each of the centrifugal flyweight members 58 extends into one of the spaced-apart recesses 55*b*. In fact, the major portion of each of the centrifugal flyweight members 58 is disposed within one of the spaced-apart recesses 55*b*.

Each of the centrifugal flyweight members 58 is appropriately dimensioned for cooperation with the spaced-apart recess 55*b* in which it is located and a conical inner surface 56 of the annular thrust washer 54. Thus, each of the centrifugal flyweight members 58 has an inner surface 72 engaging the outer surface of the sleeve 28 and an outer surface 74 remote from the inner surface. Preferably, the inner surface 72 and the outer surface 74 are circular, cylindrically shaped, and concentric. A first and second guide surface 76 and 78, respectively, are formed between the inner surface 72 and the outer surface 74 of each of the centrifugal flyweight members 58. The first and second guide surfaces 76 and 78 are flat and parallel to each other. Preferably, they are parallel to the radial plane 80 through the center of gravity of the centrifugal flyweight members. The first and second guide surfaces 76 and 78 cooperate with parallel surfaces 82 and 84 of the recesses 55*b* of the annular flyweight retainer to guide the reciprocal motion of the centrifugal flyweight members 58 without permitting substantial motion in either the axial or circumferential direction.

Each of the centrifugal flyweight members 58 is also provided with an inclined surface 86 extending inwardly and angularly away from the outer surface 74 towards the inner surface 72 thereof. The inclined surface 86 cooperates with the conical inner surface 56 of the annular thrust washer 54 to separate the dentil teeth 34 and 36, respectively, of the driving clutch member 20 and the driven clutch member 30 during an overrunning condition. The centrifugal flyweight members 58 are also provided with a third guide surface 88 disposed remote from the inclined surface 86 and extending perpendicular to each of the first and second guide surfaces 76 and 78 between the inner surface 72 and the outer surface 74. The third guide surface 88 cooperates with a base surface 90 of the internal recess 32. The base surface 90, therefore, acts as an abutment during the radial outward motion of the centrifugal flyweight member 58.

In operation, when it is desired to crank the engine, the starter drive 10 is shifted to the right via the shifting mechanism, not illustrated, so that the pinion gear 26 engages the starting gear 22. The power shaft 12 is rotated by a starting motor, not illustrated, and transmits torque through the straight splines 16 to the axially extending sleeve 14, and from the helical splines 18 to the driving clutch member 20. The driving clutch member 20 drives the driven clutch member 30 through the dentil teeth 34 and 36. The driven clutch member 30 thereby rotates the pinion gear 26 and the starting gear 22 of the engine.

As the engine fires and becomes self-operating, the starting gear 22 will drive the pinion gear 26 at a speed greater than that of the power shaft 12. The dentil teeth 34 and 36 will slip so that the starting motor is not driven at a high engine speed. In order to protect the dentil teeth 34 and 36 from severe wear due to the rubbing and clashing which would otherwise occur, and further to avoid unnecessary noise, the rapid rotation of the driven clutch member 30 drives the centrifugal flyweight members 58 radially outwardly. The movement of each centrifugal flyweight member 58 is guided by one of the recesses 55*b* of the annular flyweight retainer so as to prevent any motion of the centrifugal flyweight members 58 relative to the driven clutch member 30 other than the desired radial motion.

The outward motion of the centrifugal flyweight members 58 will bring the inclined surface 86 of the centrifugal flyweight members 58 into engagement with the conical inner surface 56 of the annular thrust washer 54, urging the annular thrust washer 54 to the left against the biasing force of the resilient spring member 50, as illustrated in FIG. 1. This motion of the annular thrust washer 54 is transferred through the loose thrust washer 67 and the radially inwardly extending shoulder 24 of the axially extending sleeve 14 to the driving clutch member 20, causing a separation of the driving clutch member 20 and the driven clutch member 30.

The starter drive 10 disclosed above has certain additional advantages over the prior art. It will be readily appreciated by those skilled in the art that the centrifugal flyweight members 58 are extremely easy and inexpensive to form, as compared with prior art centrifugal flyweight members for starter drive gearing. Furthermore, the centrifugal flyweight members 58 are very strong and may be formed from materials which might even be inappropriate for the centrifugal flyweight members 58 described previously, thereby further increasing the number of materials which may be selected from for manufacturing this component. Furthermore, precise dimensions may be provided in the recesses that are used to retain the flyweights through the use of a molded plastic flyweight retainer 55 containing the recesses 55*b*, which thereby eliminates the need to resort to complex machining or cold-forming operations in an effort to form such precisely dimensioned recesses directly in the driven clutch member 30, which is normally formed from a hard metal because of the loads and wear that it is subjected to in normal service. The annular flyweight retainer 55 is preferably formed from a hard, dimensionally stable thermoplatic material, such as a Nylon (polyamide) based material, and the flyweight retainers may be readily and inexpensively mass-produced from such a thermoplastic material by conventional injection molding practices and equipments.

The above constitutes a detailed description of the best mode contemplated at the time of filing, for carrying out the present invention. It will be apparent to those skilled in the art that many variations and modifications may be made from the above described examples without departing from the spirit of the present invention. Such variations and modifications are included within the intended scope of the claims appended hereto.

What is claimed as novel is as follows:

1. An engine starter gearing for selectively starting an engine having a starting gear, said engine starter gearing comprising:

a power shaft;

a sleeve slidably, but non-rotatably, secured to said power shaft, said sleeve having external helical splines formed on one extremity thereof;

a pinion gear slidably journalled to said power shaft for axial movement relative thereto, said pinion gear being adapted for movement into and out of engagement with said starting gear of said engine to be started;

a driven clutch member secured to said pinion gear for movement therewith;

a generally circular recess formed in said driven clutch member;

a molded plastic sleeve positioned within said generally circular recess formed in said driven clutch member, said molded plastic sleeve having an exterior surface and an interior surface;

a driving clutch member slidably mounted on said helical splines of said sleeve, said driving and driven clutch members having complementary mutually engageable inclined teeth for transmitting torque therebetween in one direction of rotation;

a barrel housing having an open end, said barrel housing being slidably supported on said sleeve and spatially encompassing said driving and driven clutch members;

abutment means disposed within said barrel housing adjacent said open end thereof, said abutment means being adapted for engagement with said driven clutch member for confining said driving and driven clutch members within said barrel housing;

resilient means disposed within said barrel housing, said resilient means abutting said driving clutch member, said resilient means further biasing said driving and driven clutch members into mutual engagement;

a radially inwardly extending shoulder formed on said driving clutch member adjacent said circular recess of said driven clutch member;

an annular thrust washer loosely disposed in said generally circular recess of said driven clutch member, said annular thrust ring having an inner conical surface, said annular thrust ring being adapted to abut said radially inwardly extending shoulder of said driving clutch member when said annular thrust ring is displaced in a first axial direction;

a plurality of centrifugal flyweight members annularly arranged within said molded plastic sleeve, said plurality of centrifugal flyweight members each having an inclined surface abutting said conical surface of said annular thrust ring, said plurality of centrifugal flyweight members being operative to displace said annular thrust ring in said first axial direction in response to centrifugal force; and a plurality of radially outwardly extending cavities formed in said interior surface of said molded plastic sleeve, each of said cavities of said plurality of cavities slidably receiving at least a portion of an associated centrifugal flyweight member of said plurality of centrifugal flyweight members to prevent circumferential movement of said plurality of centrifugal flyweight members while permitting radial movement thereof.

2. The engine starter gearing of claim 1 wherein said at least a portion of said associated centrifugal flyweight member disposed in each of said plurality of cavities is approximately axially aligned with the center of gravity of said associated centrifugal flyweight member.

3. The engine starter gearing of claim 1 wherein said resilient means and said annular thrust washer apply opposed forces to said driving clutch member.

4. The engine starter gearing of claim 1 further comprising stop means movable with said pinion gear and said driven clutch member to provide a radially inward abutment stop for said plurality of centrifugal flyweight members.

5. The engine starter gearing of claim 1 wherein said plurality of centrifugal flyweight members comprises exactly three centrifugal flyweight members and said plurality of cavities comprises exactly three cavities.

6. The engine starter gearing of claim 1 wherein each of said plurality of centrifugal flyweight members comprises a unitary member comprising:

an inner surface disposed adjacent said sleeve, said inner surface having a partial circular cylindrical shape;

an outer surface disposed remote from said inner surface;

a first guiding surface extending between said inner surface and said outer surface, said first guiding surface being flat;

a second guiding surface extending between said inner surface and said outer surface, said second guiding surface being flat and parallel to said first guiding surface; said inclined surface being formed between said outer surface and said inner surface and between said first and second guiding surfaces, and a third guiding surface extending between said inner surface and said outer surface remote from said inclined surface, said third guiding surface being perpendicular to each of said first and second guiding surfaces and extending therebetween.

7. The engine starter gearing of claim 6 wherein said first and second guiding surfaces are parallel to the radial plane through the center of gravity of said centrifugal flyweight member.

8. The engine starter gearing of claim 7 wherein said outer surface has a partial circular cylindrical shape and is concentric with said inner surface.

9. The engine starter gearing of claim 1 wherein said driven clutch member has an inner surface with projection means projecting radially inwardly therefrom and wherein said exterior surface of said molded plastic sleeve has recess means projecting radially inwardly thereinto, said recess means in said exterior surface of said molded plastic sleeve engages said projection means in said inner surface of said driven clutch member to circumferentially orient said molded plastic sleeve with respect to said driven clutch member.

* * * * *

UNITED STATES PATENT AND TRADEMARK OFFICE

CERTIFICATE OF CORRECTION

PATENT NO. : 4,712,435

DATED : December 15, 1987

INVENTOR(S) : Losey et al

It is certified that error appears in the above-identified patent and that said Letters Patent is hereby corrected as shown below:

Column 4, line 20, before "mounted" insert ---- slidably ----.

Column 5, line 7, delete "32 located" and insert ---- 32. Located ----.

Column 6, line 38, delete "and" and insert ---- to ----.

Column 6, line 39, delete "axially extending sleeve 14 to the ----.

Column 6, line 64, delete "thermoplatic" and insert ---- thermoplastic ----.

In the Claims

Column 7, line 54, delete "washer" and insert ---- ring ----.

Column 8, line 18, delete "washer" and insert ---- ring ----.

Column 8, line 45, delete "surfaces," and insert ---- surfaces; ----.

UNITED STATES PATENT AND TRADEMARK OFFICE

CERTIFICATE OF CORRECTION

PATENT NO. : 4,712,435

DATED : December 15, 1987

INVENTOR(S) : Losey et al

It is certified that error appears in the above-identified patent and that said Letters Patent is hereby corrected as shown below:

In the Abstract line 28, delete "respose" and insert ---- response ----.

In the Drawings

Figure 1, kindly extend the lead line of numeral 24.

Signed and Sealed this

Sixteenth Day of August, 1988

*Attest:*

DONALD J. QUIGG

*Attesting Officer*

*Commissioner of Patents and Trademarks*